US007937917B2

(12) United States Patent
Mattes

(10) Patent No.: US 7,937,917 B2
(45) Date of Patent: May 10, 2011

(54) SADDLE PAD HAVING INTEGRATED PLATE-SHAPED SPRING DEVICE FOR PRESSURE DISTRIBUTION AND STABILIZATION

(75) Inventor: Peter Mattes, Mahlstetten (DE)

(73) Assignee: E.A. Mattes GmbH, Tuttlingen (DE)

( * ) Notice: Subject to any disclaimer, the term of this patent is extended or adjusted under 35 U.S.C. 154(b) by 1241 days.

(21) Appl. No.: 11/501,924

(22) Filed: Aug. 9, 2006

(65) Prior Publication Data

US 2007/0144114 A1 Jun. 28, 2007

(30) Foreign Application Priority Data

Aug. 12, 2005 (DE) ..... 10 2005 038 568

(51) Int. Cl.
*B68C 1/12* (2006.01)
*B68C 1/10* (2006.01)

(52) U.S. Cl. ..... 54/66; 54/44.4

(58) Field of Classification Search ..... 54/44.4, 54/44.5, 65, 66

See application file for complete search history.

(56) References Cited

U.S. PATENT DOCUMENTS

| | | | | |
|---|---|---|---|---|
| 115,772 A | | 6/1871 | Schmidt | |
| 184,975 A | | 12/1876 | McCormick | |
| 270,142 A | | 1/1883 | Spencer | |
| 291,887 A | * | 1/1884 | Felker | 54/66 |
| 530,864 A | | 12/1894 | Torrey | |
| 586,481 A | | 7/1897 | Erselius | |
| 721,653 A | | 3/1903 | Amos | |
| 4,683,709 A | | 8/1987 | Vasko et al. | |
| 5,027,589 A | * | 7/1991 | Gleb et al. | 54/66 |
| 5,353,577 A | | 10/1994 | Thurston | |
| 5,575,139 A | | 11/1996 | Green | |
| 5,802,823 A | * | 9/1998 | Woods | 54/66 |
| 6,050,067 A | * | 4/2000 | Knight et al. | 54/44.6 |
| 6,125,616 A | | 10/2000 | Brown | 54/66 |
| 6,615,568 B1 | | 9/2003 | Roskies | 54/66 |
| 2005/0048257 A1 | | 3/2005 | Mattes et al. | 428/131 |

FOREIGN PATENT DOCUMENTS

| | | | |
|---|---|---|---|
| DE | 101 33 751 | 1/2003 | 1/12 |
| EP | 0078657 | 10/1982 | 1/12 |
| WO | WO 90/00518 | 1/1990 | 1/12 |

* cited by examiner

*Primary Examiner* — Rob Swiatek

(74) *Attorney, Agent, or Firm* — O'Shea Getz P.C.

(57) ABSTRACT

A saddle pad that exhibits pockets on its top side facing toward a saddle to be laid on, arranged along and to the left and right of a line of symmetry of the saddle pad. The pockets extend over the entire length of the saddle pad. Inserted into the pockets is a plate-shaped spring device, by which optimal stabilization and pressure distribution are achieved, even when treeless saddles are provided for the riding of a riding animal.

9 Claims, 3 Drawing Sheets

SADDLE PAD HAVING INTEGRATED PLATE-SHAPED SPRING DEVICE FOR PRESSURE DISTRIBUTION AND STABILIZATION

PRIORITY INFORMATION

This patent application claims priority from German patent application 10 2005 038 568.0 filed Aug. 12, 2005, which is hereby incorporated by reference.

BACKGROUND INFORMATION

The invention relates to the field of saddle pads.

Saddle pads that are laid under saddles of horses have long been known. An example of such a saddle pad was described in the applicant's German Patent DE 101 38 317 B4. This saddle pad includes two panels that are connected to one another via a web. The panels are provided with a covering of lambskin or wool fleece on the side facing toward the riding animal. A recess in the shape of a longitudinal groove is worked into the web in that no such covering is provided there. By virtue of the groove-like recess, the saddle pad does not rest on the spine of the riding animal but rather on the flanks of the riding animal. For this reason no pressure is exerted on the spine from above. Instead, the weight of the rider seated on a saddle is distributed onto the flanks of the riding animal in large-area fashion via the panels of the saddlecloth.

Another saddle pad is known from WO 90/00518. There the saddle pad has, on its top side facing toward the saddle, two pockets into each of which wooden-ball mats are inserted. These wooden-ball mats are supposed to massage the back of the riding animal during riding.

For optimally distributing the pressure when the riding animal is being ridden and for stabilizing the rider, both known saddle pads require saddles into which a so-called saddletree is integrated. The term saddletree refers to a relatively rigid plastic or wood frame that is built into the saddle for stabilization. The pressure load during riding of the horse is broadly distributed via such treed saddles.

Problematic, however, are so-called treeless saddles, that is, relatively flexible saddles that exhibit in themselves no or almost no stability. Such saddles are often made from fabric or plastic. Such treeless saddles require saddle pads that better distribute the pressure load when the riding animal is being ridden.

A saddle pad in which an improved pressure distribution is achieved when the riding animal is being ridden is described for example in DE 101 33 751 A1. In a first embodiment of the saddle pad, the latter comprises a foamable plate-shaped shell, which takes on a fixed shape in the cured condition. The foamable material is introduced, for example molded, injected or the like, into a film-like shell acting as a mold, which represents a restraint for the not yet foamed, viscous or deformable plastic material, in order to avoid softening of the foamed material in the uncured state. In the fitting of this saddle pad, the latter is placed between the riding saddle and the horse's back. When the saddle is laid on the horse's back, the weight of the saddle and of the rider is imposed on the saddle pad having the not yet cured foamable material. The weight of the saddle and of the rider transmits this load via the saddle pad to the horse's back. Thus the soft, viscous or deformable, uncured plastic material located inside the saddle pad is deformed in accordance with the load exerted by the saddle and by the rider, the contour of the bottom side of the saddle being imparted to the top side of the saddle pad while at the same time the deformable plastic material on the bottom side adapts exactly to the contour of the horse's back. In the uncured condition, an impression of the bottom side of the saddle and of the horse's back is formed on both surfaces of the saddle pad. Subsequently, the self-curing plastic material of the saddle pad is cured, the stated impression shape on both sides being retained. In this way the saddle pad holds this shape permanently.

In a second embodiment of DE 101 33 751 A1, the saddle pad comprises a plate of plastic or foamed material into which recesses are machined at certain critical places. The curable material is introduced into these recesses. The saddle pad is then fitted to the horse's back, as described above, by laying it on the horse's back and placing a saddle with rider thereon.

What is problematic in these known saddle pads is the use of a curable material within the saddle pad. If, for example, the musculature of the horse changes, as it can solely through the aging process of a horse, a saddle pad fitted in this way may become no longer serviceable under some circumstances. In addition, the saddle pad once so fabricated is fitted only for a quite specific horse.

There is a need for a treeless saddle that is not limited to use for a single riding animal.

SUMMARY OF THE INVENTION

A saddle pad includes on its top side, that is, the surface facing toward the saddle, two pockets into each of which a plate-shaped spring device is inserted. The pockets extend over the entire length of the saddle pad or at least approximately over the entire length.

The saddle pad is positioned beneath the saddle of a riding animal such that the front ends of the plate-shaped spring device come to lie beneath the so-called pommel or fork of the saddle. Here the terms pommel and fork refer to those parts that enclose the back of the horse in U-shaped fashion at the front end of the saddle, that is, toward the horse's head, and position the saddle. Such a pommel is commonly made of metal and determines the gullet width of the riding saddle. In many saddles, the pommel can be changed by the rider in order to fit the saddle to various horses.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
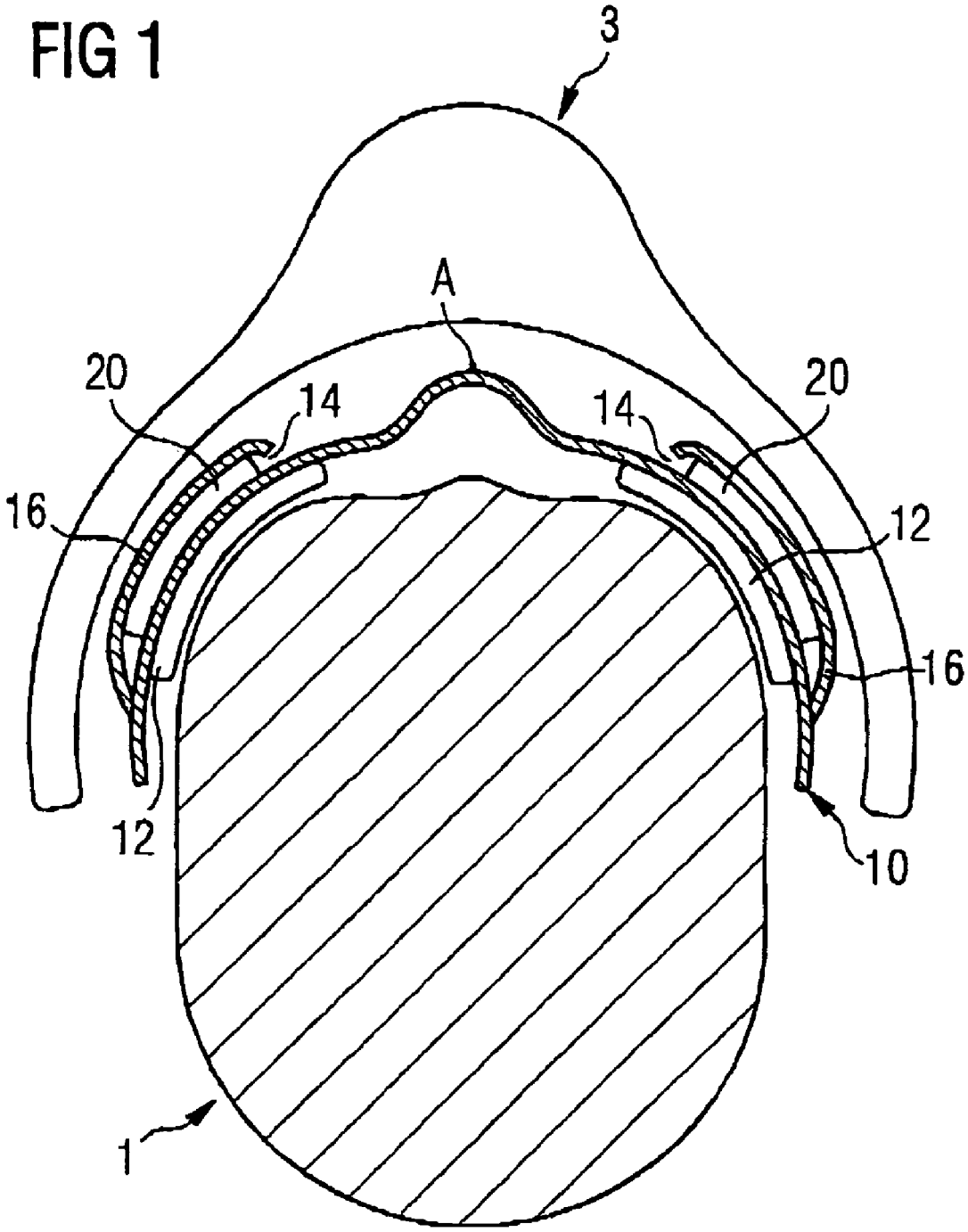
FIG. 1 is a schematic cross section of a horse having the saddle pad and saddle in place, viewed from the rear.

FIG. 1 illustrates a sectional view from the rear of the rump of a horse 1 having a saddle pad 10 in place. Resting on the saddle pad 10 is a saddle 3, preferably a treeless saddle 3.

Figure 3:
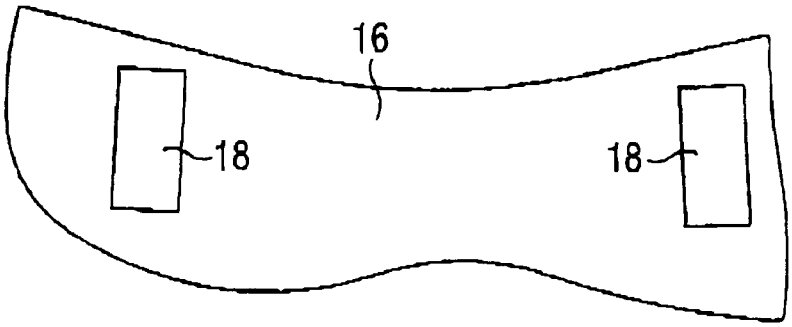
FIG. 3 illustrates the pocket of FIG. 2 in the removed condition, viewed from its attachment side.

On its bottom side, that is, the side facing toward the horse 1, the saddle pad 10 comprises a padding or covering 12 of lambskin or wool fleece as described in detail in German Patent DE 101 38 317. On the opposite side, that is, the top side, the saddle pad 10 has two pockets 16, which are arranged parallel to line of symmetry A of the saddle pad 10 on the left and right. Each of the pockets 16 extends over the entire length of the saddle pad 10 and has an opening 14, preferably on the edge facing toward line of symmetry A. The opening 14 preferably runs parallel to the line of symmetry A of the saddle pad 10. In the embodiment illustrated, the pockets 16 are each separably attached to the top side of the saddle pad 10 via two hook-and-loop fasteners 18 (see FIG. 3 in this connection).

The pockets 16 and the saddle pad 10 itself can be formed from a quilted material. Other materials are, however, also possible.

For stabilization and optimal pressure distribution when the saddle 3 and the rider are in place, a plate-shaped spring device 20 is inserted into the pockets 16 starting from the opening 14.

Figure 2:
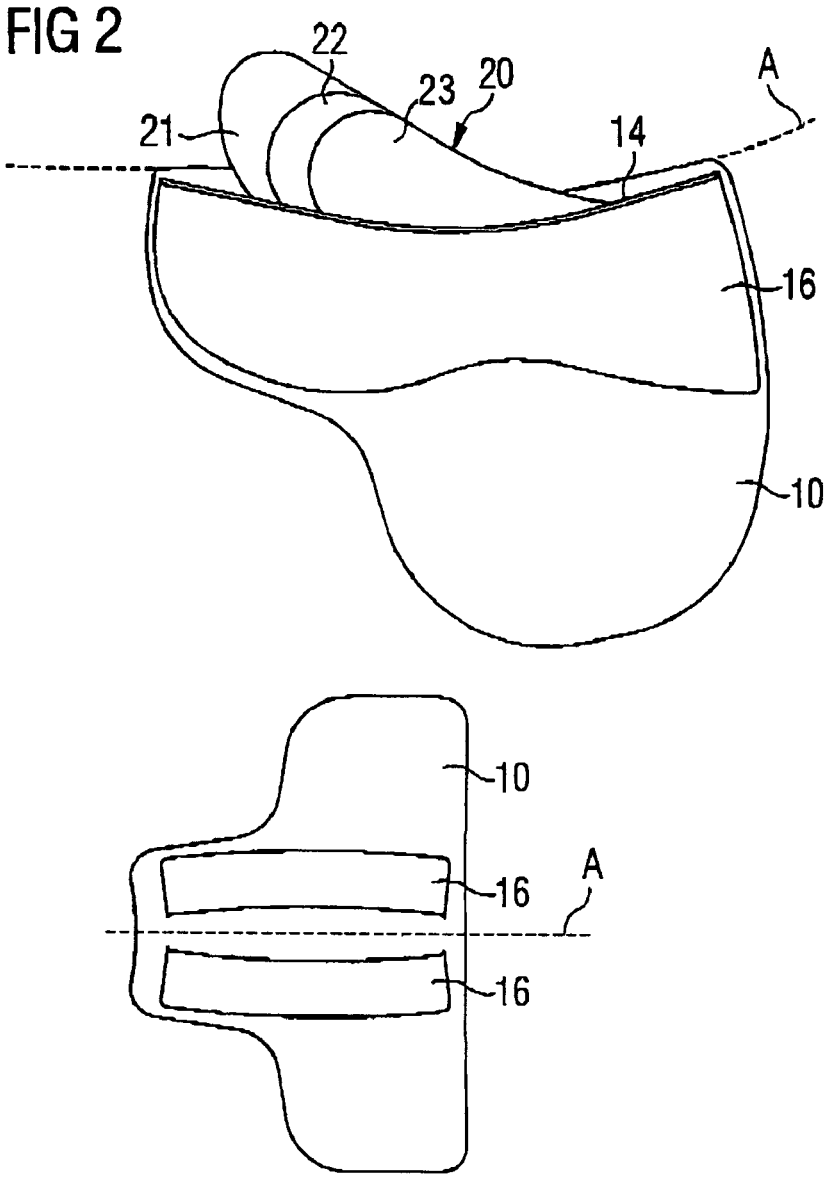
FIG. 2 illustrates a lateral view of the saddle pad of FIG. 1 having a plate-shaped spring device inserted in pockets.
Figure 4:
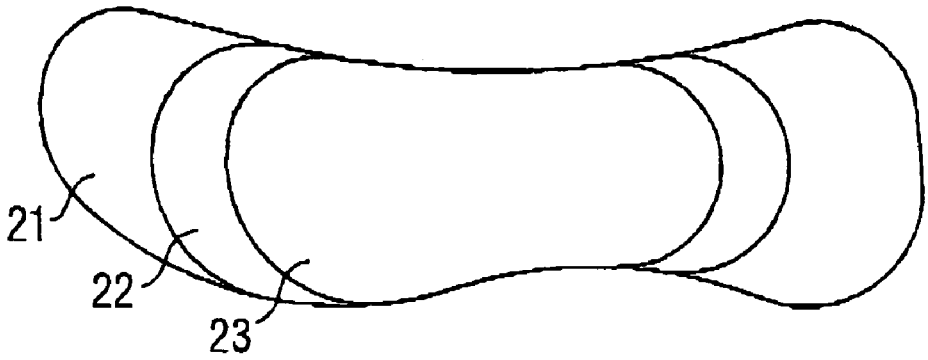
FIG. 4 illustrates an embodiment of the plate-shaped spring device in the form of a leaf-spring assembly, in an overhead view.
Figure 5:
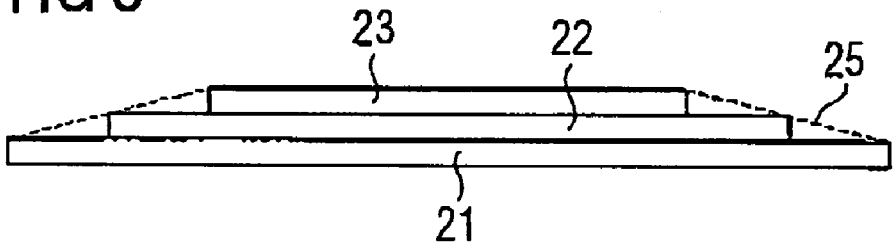
FIG. 5 depicts the leaf-spring assembly of FIG. 4 in lateral view.

As illustrated in FIG. 2, FIG. 4, and FIG. 5, the plate-shaped spring device 20 comprises three spring plates 21, 22, 23, which are fastened together in the manner of a spring assembly. The individual spring plates 21, 22, and 23 are made for example of plastic. With respect to line of symmetry A, the lowermost spring plate 21 is longest and the topmost spring plate 23 is shortest. The middle spring plate 22 has a length that is shorter than the longest spring plate 21 and longer than the shortest spring plate 23. The three spring plates 21, 22, 23 have, however, approximately the same width.

The longest spring plate 21 is designed so that it completely fills the pocket 16, so that the spring assembly extends over the entire length of the saddle pad 10.

By virtue of the layered arrangement of the spring plates 21, 22, and 23 in the manner illustrated in FIG. 4 and FIG. 5, the greatest spring tension is present in the middle of the spring assembly. This greatest spring tension in the middle of the spring assembly decreases toward the front and rear ends of the spring assembly. The spring leaves 21, 22, and 23 can be separably or inseparably held together in a wide variety of ways, for example by spring collars or clips or, however, also by simple cementing.

Even though a spring assembly was described as the plate-shaped spring device 20 in connection with the exemplary embodiment illustrated, it is also conceivable in principle to form the plate-shaped spring device 20 by a single spring plate. In connection with FIG. 5, this is indicated by the dashed line 25. All that need be ensured is that the spring plate exhibits a greater thickness in the middle than at its front and rear ends.

If in connection with FIG. 2 it is illustrated that the opening 14 is arranged approximately parallel to line of symmetry A of the saddle pad 10, it is also possible in principle to arrange the opening 14 not parallel to the line of symmetry A but perpendicular thereto, for example at the rear or front edge of the pocket 16. In this case, however, it is necessary to make sure that the opening can be closed after the insertion of the plate-shaped spring device 20, for example with snaps, a hook-and-loop fastener, or the like, so that the spring device 20 cannot accidentally slip out of the pocket 16.

The pockets 16 illustrated in the drawings are separably fastened to the saddle pad 10 with hook-and-loop fasteners 18. In this way the pockets 16 rest on the saddle pad 10 as separate parts.

In another embodiment, the pockets 16 can also be worked into the saddle pad 10 itself, similar to the arrangement indicated in the document WO 90/00518 described at the outset.

Figure 6:
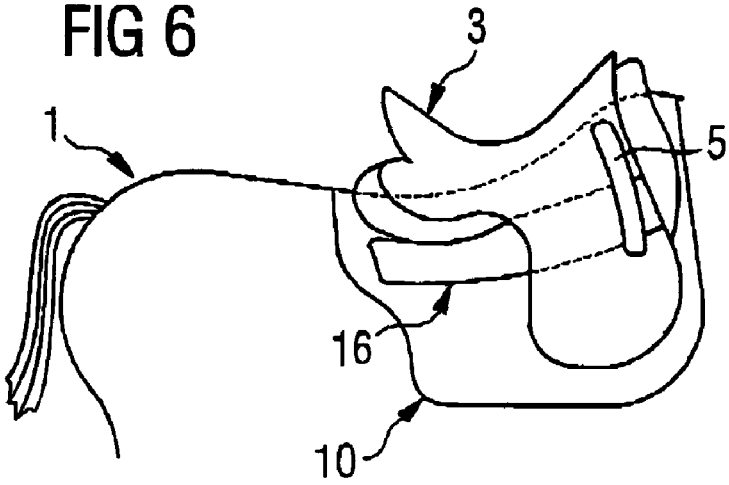
FIG. 6 is a lateral excerpted illustration of a horse with the saddle pad according to the invention in place and with the saddle placed on the saddle pad.

The employment of the saddle pad 10 according to the invention is made clear in connection with FIG. 6. The saddle pad 10 with the pockets 16 previously discussed lies on the back of the riding animal 1. The saddle 3 rests on the saddle pad 10. On its side facing toward the horse's head, the saddle 3 includes a so-called pommel 5, which lies in U-shaped fashion over the shoulder muscle of the horse 1. The saddle pad 10 with its pockets 16 and the plate-shaped spring device 20 inserted thereinto is slid beneath the saddle 3 in such fashion that the spring device 20 has its front end securely intruding beneath the pommel 5. In this way it is ensured that the pommel 5 can be braced on the spring device 20 and the pommel 5 does not press uncomfortably onto the musculature of the horse 1.

Although the present invention has been illustrated and described with respect to several preferred embodiments thereof, various changes, omissions and additions to the form and detail thereof, may be made therein, without departing from the spirit and scope of the invention.

What is claimed is:

1. A saddle pad comprising pockets on a top side thereof facing toward a saddle to be laid on the saddle pad, where the pockets extend at least approximately parallel to a line of symmetry over a length of the saddle pad and that at least one plate-shaped spring device sits in each of the pockets, where the plate-shaped spring device comprises a leaf-spring assembly having at least two stacked spring plates having substantially equal widths, and where the leaf spring assembly extends approximately the length of the pad.

2. The saddle pad of claim 1, where the plate-shaped spring device sits separably in the pockets.

3. The saddle pad of claim 1, where the pockets are separably arranged on the saddle pad.

4. The saddle pad of claim 3, where the pockets are secured to the saddle pad by hook-and-loop fasteners.

5. The saddle pad of claim 1, where the pockets are worked into the saddle pad.

6. The saddle pad of claim 1, where openings of the pockets run approximately parallel to the line of symmetry of the saddle pad.

7. The saddle pad of claim 1, where the plate-shaped spring device fills the pockets completely or at least approximately completely.

8. The saddle pad of claim 1, where the spring plates are formed from plastic.

9. The saddle pad of claim 8, where the plate-shaped spring device is rounded off on its front and rear ends.

* * * * *